United States Patent [19]

Kalb

[11] 3,958,600

[45] May 25, 1976

[54] COMBINED STARTING AND RAPID SHUT-OFF MECHANISM FOR STEAM AND GAS TURBINES

[76] Inventor: Hans Kalb, Frankenstrasse 81, 8500 Nurnberg, Germany

[22] Filed: Jan. 9, 1974

[21] Appl. No.: 432,099

[30] Foreign Application Priority Data

Jan. 25, 1973 Germany ..... 2303511
May 25, 1973 Germany ..... 2327443

[52] U.S. Cl. ..... 137/630; 251/29
[51] Int. Cl.[2] ..... F16K 17/10
[58] Field of Search ..... 137/485, 488, 491, 489, 137/614.16, 614.17, 614.18, 490, 630; 251/35, 25, 55

[56] References Cited

UNITED STATES PATENTS

| | | | |
|---|---|---|---|
| 2,622,612 | 12/1952 | Manhartsberger | 137/490 X |
| 3,100,503 | 8/1963 | Tennis | 137/491 |
| 3,125,319 | 3/1964 | Arbogast et al. | 251/29 |
| 3,182,681 | 5/1965 | Gallo | 137/490 X |
| 3,478,776 | 11/1969 | Royer | 137/491 |
| 3,545,484 | 12/1970 | Allen | 137/490 |

*Primary Examiner*—Martin P. Schwadron
*Assistant Examiner*—Robert J. Miller
*Attorney, Agent, or Firm*—Ross, Ross & Flavin

[57] ABSTRACT

In a combined starting and quick shut-off mechanism, for steam and gas turbines, having a valve controlled by pressure medium by means of an auxiliary valve the valve has a secondary control piston and a counter-pressure closure upon opening as well as an adjustable damping which is adjustable by means of a flow cascade from the inlet side of the valve to an outlet chamber, controlled by the auxiliary valve, at the end of the valve spindle, from the inlet side of the valve to the pressure chamber of the valve piston here exists, via a radial piston chamber, stepped in its outer diameter, of the secondary control piston a further flow passage can be provided in the interior of the valve piston, which passage can be shut-off at the step of the radial piston chamber by means of an annularly projecting control collar of the secondary control piston in the open position thereof.

1 Claim, 2 Drawing Figures

COMBINED STARTING AND RAPID SHUT-OFF MECHANISM FOR STEAM AND GAS TURBINES

FIELD OF THE INVENTION

This invention relates to a combined starting and rapid shut down mechanism for steam and gas turbines.

Rapid shut down mechanisms are known in which valve and valve actuating mechanisms are connected together by means of valve rodwork and spacers, the actuating mechanism being controlled by a separate pressure medium (for example, oil or water). These known quick mechanisms often have a great over-all length, since the pressure medium of the actuating mechanism has to be kept far away from the effect of high temperatures and therefore a great spacing has to be maintained between the valve, through which the hot driving medium flows, and the actuating mechanism. Steam or gas losses through leakage at the spindle bushing are also disadvantageous in this connection. Moreover, these mechanisms cannot be used as starting safety mechanisms.

OBJECT OF THE INVENTION

An object of the invention is to provide a combined starting and rapid shut down mechanism which is distinguished by its relatively short over-all length and which has an automatically controlled stroke damping upon the opening of the valve.

BRIEF DESCRIPTION OF THE INVENTION

The invention provides a combined starting and quick shut-off mechanism for steam and gas turbines. It includes a main valve controlled by the pressure medium by means of a control valve. The main valve has a valve piston which forms a valve closure body and a guide cylinder which forms, with that side of the valve piston which is remote from a valve seat, a pressure chamber. The main valve is provided with a valve spindle sliding with comparatively great play in a spindle bore, which spindle bore widens into an adjoining spindle chamber. There is also a connection to the valve inlet side which is controllable, on the one hand, via a channel to a pressureless outlet, and on the other hand, by means of a control valve piston. Guided in the main valve piston at its seat end is a secondary valve closure member which is stepped and which has a part with a smaller cross-section which constitutes a closure extension, and which can be acted upon, at the side remote from the seat end, by pressure from the spindle chamber and which can be acted upon, at the other side, by pressure in a transverse bore in the main valve piston at the annular surface of the shoulder and passaged directly from the inlet side of the valve. There is also an axial bypass channel at the outer periphery of the valve spindle which defines, in the vicinity of the complete open position of the valve, a flow connection between the pressure chamber of the valve piston and the spindle chamber and whereby a throttle-like flow connection exists between the inlet side of the valve and the pressure chamber of the valve piston. This flow connection and the gap between the spindle and its bore form a flow cascade for determination of the cylinder pressure in the pressure chamber in a specific ratio to the force of the driving medium.

The mechanism of the invention has the advantage that the main valve is balanced and the driving medium is used for actuation of the main valve piston, no great amounts of separate pressure medium being required for the actuation.

It is advantageous to provide a further flow passage in the main valve piston, extending from the inlet side of the main valve to the pressure chamber of the valve piston, via a radial piston chamber, which is stepped in its outer diameter, of the secondary valve member, which passage can be shut-off at the radial piston chamber by means of an annular projecting control collar of the secondary valve member in an open position thereof.

It is further advantageous that the stepped radial piston chamber of the secondary valve member constitutes a pressure chamber which is situated at the pressure-loaded stage thereof, and it is also advantageous to arrange the annular control collar at the stage of the secondary valve member. Through this design, starting and quick shut-off is achieved in that, at the most weakly throttled flow connection, which exists in the event of closure of the valve and which is shut-off in the open state, the driving medium can reflow into the pressure chamber during the closure in a sufficient amount to reduce the delay of the closure procedure to a minimum.

DESCRIPTION OF PREFERRED EMBODIMENTS

Figure 1:
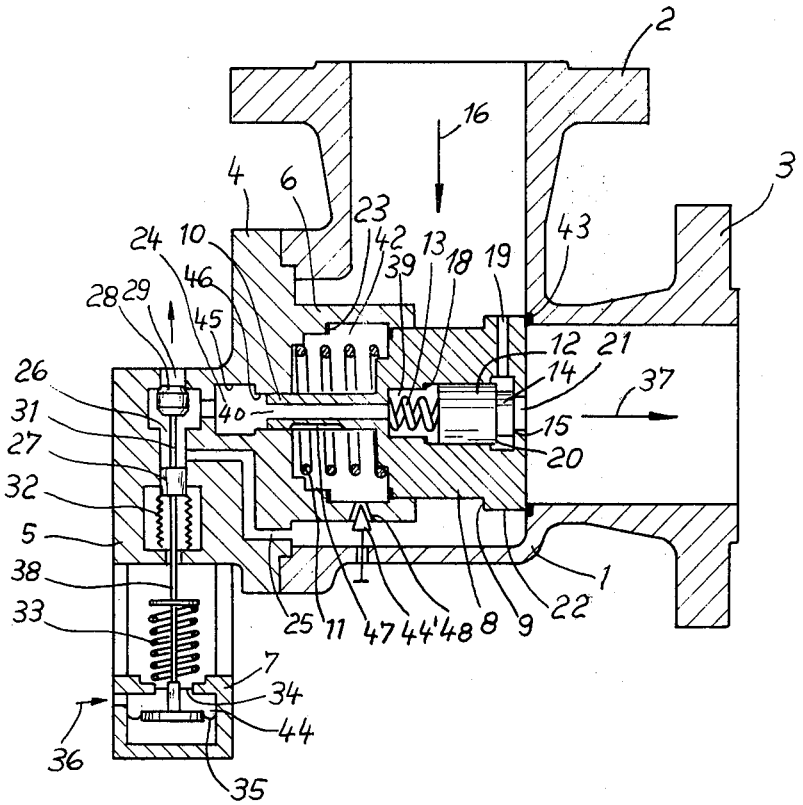
FIG. 1 is a cross-section through a preferred embodiment of mechanism in accordance with the invention.

In the mechanism of FIG. 1, a valve housing 1 can have any convenient practical outer shape, and is provided with an inlet connection 2 and an outlet connection 3 and is sealed coaxially with the outlet connection 3 by a flange 4. Connected securely to the flange 4 is a guide cylinder 6 which is armour-plated sealed inside as well as at a shoulder 23.

Mounted in the guide cylinder 6 is a main valve piston 8, an axial extension of which is in the form of a spindle 10 extending through a bore 46 formed in the flange 4. The spindle 10 is a loose fit in bore 46, leaving an annular gap between itself and bore 46.

By means of a heat-resistant compression spring 11, which is supported on one side against the flange 4, the valve piston 8 is urged against a main valve seat 43 in the housing 1. Incorporated with radial play in the valve piston 8 is a secondary valve member 12. A contact spring 13 urges a cylindrical extension 14 of secondary valve member 12 against a valve seat 15 in the main valve piston 8 and seals the bore 21 tightly.

Arranged at right angle to the axis of the main valve in the shoulder 5 of the flange 4 is a three-way control valve which consists of a valve cone 28, a spindle 31, a relieving or dummy piston 27 having a linkage 38 and folding bellows 32. Used as the adjusting member for actuation of the three-way control valve (in place thereof mechanical or electrical adjusting members can also be provided) is preferably a membrane adjusting member 7.

In the described valve arrangement, no stuffing box or gland whatsoever is necessary, so that no continuous leakage medium outlet is necessary and, on the whole, driving medium losses occur only during the opening of the main valve and then only to a very slight degree.

If, in the case of the embodimnt of FIG. 1, the membrane chamber 44 is not loaded with pressure via the signal line 36, the cylindrical compression spring 33 forces the valve cone 28 against the seat of the bore 29 and seals this latter.

Opening of the valve is initiated by pressure loadng of the membrane chamber 44 by means of signal pressure via the line 36. By virtue of the surface difference of the membranes 34 and 35, the rodwork 38 is tightened against the bias of the spring 33, the valve cone 28 is stroke-actuated and the valve bore 29 is opened with immediate subsequent closure of the valve bore 26. By this means, the secondary valve closure member 12 is displaced, by the force of the driving medium on the annular surface 20, in the direction of the contact spring 13 until the cylinder part of the secondary valve closure member 12 comes into abutment against the valve seat 18.

Now, the pressure medium can flow, via the opened bore 21, into the outlet connection 3 for pre-heating of the subsequently connected parts of the turbine. Only if a predetermined pressure of driving medium is built up in the outlet connection 3, i.e. for example in the case of steam if the subsequently connected plant parts are warmer than corresponds to the condensation temperature, or the subsequently connected control valves and the drainages are shut off, does the main valve piston 8 (which has hitherto still been held by the full force of the driving medium acting on the annular shoulder 9 of the valve piston in the closed position) lift in a balanced manner from the housing seat 43.

However, caused by the flow cascade which is formed by the bore 48 and the annular gap between valve spindle 10 and bore 46 and via which there is a flow of driving medium with given free auxiliary valve opening, there now prevails in the pressure chamber 42 a specific pressure which can be adjusted to a different amount, of by way of example 80 or 90 o/o of the full pressure of driving medium. Thus, if the valve piston 8 goes backwards, it compresses to a certain extent the quantity of driving medium enclosed in the pressure chamber 42 and thus brings about a damping of the opening movement: Finally, in this connection, it comes into a positon in which the bypass channel 47 cancels the throttle effect of the cascade to a large extent, so that the valve piston is once more accelerated and rapidly releases the remaining aperture cross-section at the valve seat 43.

The opening movement of the piston 8 is thus effected substantially in two stages, the first of which is damped more severely. This opening characteristic is variable in wide limits by selection and arrangement of the flow cross-sections. To this end, a needle valve 44' is provided. In any case, however, too hard an application of the valve piston 8 onto the seat 23 is prevented.

Since, in the open state, the valve body 8 butts securely against the axial seat and the secondary valve member 12 butts securely against the valve seat 18, no driving medium can flow out via the channel 47 and the bore 40, so that therefore no leakage losses occur.

In the case of rapid closure by pressure reduction in the membrane or diaphragm chamber 44, the valve bore 26 is opened and the valve bore 29 is shut-off, whereby the pressure chambers 39 and, initially, also 42, are loaded via the by-pass channel 47 once more with the full force of the driving medium.

After a certain closing path, the by-pass channel 47 is once more shut-off, whereby the further filling of the pressure chamber 42 is effected only through the bore 48 and the annular gap at the bore 46. By this means, the valve is also suitable for the limitation of the adjusting speed upon the closure in the case of large valve masses — in order to avoid too hard an impact — in that by adjustment or dimensioning of the bore 48 the afterfilling of the pressure chamber 42 is effected in a more severely throttled manner. Finally, at the end of the closing stoke, the closing force is increased again somewhat by virtue of the differential pressure upon throttling of the supply of drivng medium, whereby the abating closure force of the compression spring 47 is compensated, so that altogether a necessarily rapid but comparatively uniform closure is achieved.

The three-way control valve with adjusting member 7 is intrinsically safe in design.

a. Upon breakage of the membrane 34 and/or 35, the valve cone 28 is forced by the spring 33 against the seat of the bore 29 and a rapid closure of the valve piston 8 is initiated.

b. Upon leakage or breakage of the bellows 32, the cut-out safety is not endangered, because bellows 32 and relieving piston 27 have equal effective surfaces.

c. Upon breakage of the compression spring 33, by virtue of different effective surfaces of relieving piston 27 and valve 28 — relieving piston 27 is smaller in diameter — the cut-out safety is not endangered, because the valve cone 28 is forced by the force of the driving medium against the seat of the bore 29 and thus a rapid closure of the valve piston 8 is automatically initiated.

The mode of operation of the valve as a starting and quick-acting gate safety valve is advantageous for steam turbines. In this connection, the opening cross-section 21 of the pre-stroke valve is dimensioned in such a way that, if the control valves of the turbine are opened, this latter can in no way start up on account of the pre-heating steam quantity. That is only possible when the regulating and drainage valves are closed and thus the valve piston 8 opens.

In the case of the valve in accordance with FIG. 1, on account of the throttling of driving medium which flows from the inlet side of the valve via the pressure chamber of the valve piston to a pressure-less chamber, in the event of the valve opening, behind the valve spindle, an adjustable damping of the opening movement of the valve piston is achieved. However, this has the effect of a certain delay occurring, upon the closure of the valve, on account of this flow path which is severely throttled in cascade-like manner. This delay upon closure of the valve is reduced in the case of the embodiment of FIG. 2.

Figure 2:
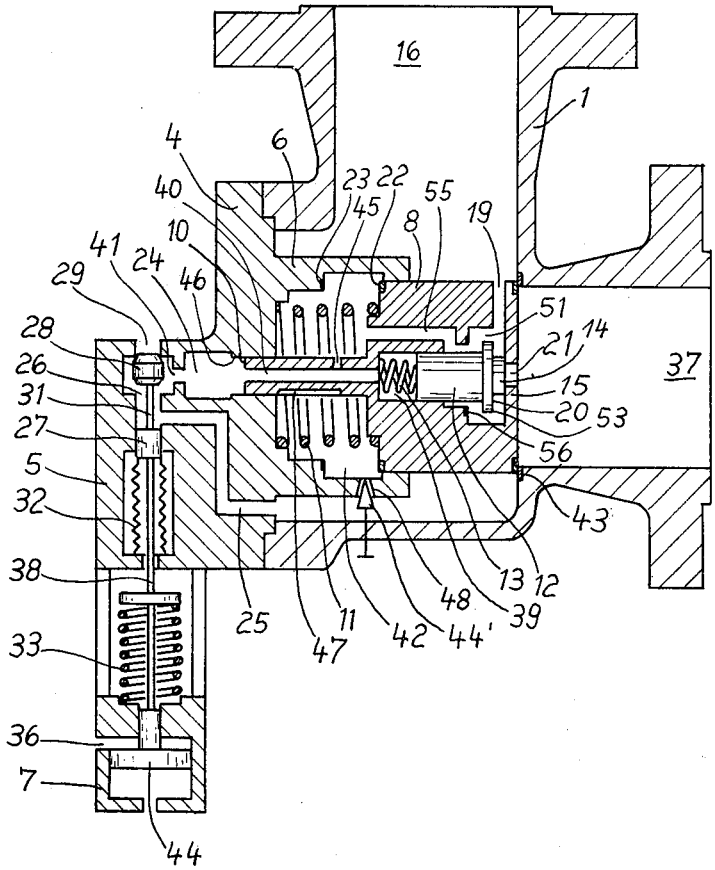
FIG. 2 is a view similar to that of FIG. 1 but showing a modified mechanism.

In the construction of FIG. 2, a valve housing 1 is provided with an inlet connection 16 and an outlet connection 37 and is sealed coaxially with regard to the outlet connction 37 by a flange 4. Securely connected to the flange 4 is a tubular cylinder 6, the radial piston guide part and axial annular surface 23 of which are armour-plated or sealed, hardened.

Incorporated in the tubular cylinder 6 and mounted with some radial play is a valve piston 8, the spindle 10 of which is likewise guided in a bore formed in the flange 4.

By means of a heat-resistant compression spring 11, which is supported on one side against the flange 4, the valve piston 8 is urged towards the valve seat 43 in the housing 1. Installed with radial play in the valve piston 8 is a secondary valve member 12 which is in the form of a stepped piston and whose cylindrical shoulder 14 is forced by a contact spring 13 against a valve seat 15 in the valve piston 8 and tightly seals the bore 21.

Arranged at a right angle to the axis of the main valve in the shoulder of the flange 4 in a three-way control valve 5 which consists of valve cone 28, spindle 31, relieving piston 27 with rodwork 38 and bellows 32. Used as adjusting member for the actuation of the three-way control valve(in place thereof mechanical or electrical adjusting members can also be mounted) is a serve adjusting member 7.

In the valve of FIG. 2, the driving medium passes from the inlet side 16 of the valve 1 through the channel 25 via the opened valve bore 26 and channel 41 into the secondary cylinder 39, and via the radial bores 19, the piston chamber 51 and the channel 55 into the pressure chamber 42.

By the pressure in chamber 42, the valve piston 8 is forced in strengthened manner against the valve seat 43 in the housing 1. Also the secondary valve member 12, the spring-side piston surface of which is acted upon via the bore 40 with driving medium force, is forced with its cylindrical extension 14 in reinforced manner against the valve seat 15 in the valve piston 8, so that no driving medium passes into the outlet 37.

The opening of the starting and quick shut-off valve is initiated by triggering of the servo adjusting member 7 by means of signal pressure from a safety circuit. By pressure-loading of the piston 44, the rodwork 38 is actuated against the bias of the spring 33, the valve cone 28 is stroke-actuated and the valve bore 29 is opened, with immediate subsequent closure of the valve bore 26. By this means, via the channel 41 and the bore 40 the force of driving medium in the cylinder 39 is reduced and the valve member 12 is actuated by the compressive force, acting on the shouder 20, in a direction opposed to the force of the contact spring 13 until the control collar 53 comes into abutment against the annular seat 56 formed by the step of the piston chamber 51 and tightly shuts off the connection between the channels 19 and 55. Now, driving medium can flow via the released bore 21, into the outlet connection 37, for pre-heating the subsequently conncted pipeline and/or regulating valve housing.

The opening cross-section of the bore 21 is dimensioned in such a way that, if the regulating valves of the turbine are opened, in no case can the turbine start in uncontrolled manner on account of the preheated driving medium. Only if the regulating valves and drainage valves in the regulating valve housing are closed, and thus a pre-selectable force of driving medium is built up (as a rule 80 to 90 o/o of the inlet pressure) in the outlet connection 37, does the valve piston 8 lift off from the housing seat 43.

The opening pressure is determined by the cascade ratio of throttle cross-section 48 of the throttle 44' and of the bore 45, the throttle cross-section 48 being, as a rule, adjustable for the adjustment of the counter pressure in the cylinder 42.

However, instead of the bore 45, a correspondingly large annular gap between valve spindle 10 and bore 46 can also be provided, whereby similar conditions arise, or both ways can also be used in a combined manner. On account of the now full pressure build-up in the outlet connection 37, the valve piston 8 is first of all accelerated in the opening position, is braked once more by pressure build up due to compression in the cylinder 42, until it finally comes into abutment with its axial sealing collar 22 against the cylinder seat 23.

In the open state, driving medium can now no longer flow into the cylinder chamber 42, and a by-pass groove 47 in the piston rod 10 connects, in the vicinity of the open end-positon, the cylinder chamber 42 to the pressureless channel 41.

Upon the opening procedure, the cascade pressure in the pressure chamber 42 determines the strength of damping. Depending on how far the by-pass channel 47 is extended at the valve spindle towards the valve piston 8, there is effected by release of the by-pass in the vicinity of the opening end-position a rapid build-up of the cylinder pressure, so that the last part of the opening path can be covered comparatively quickly by the valve piston 8.

In the case of rapid closure release triggering by disconnecting of the signal pressure in the servo adjusting member 7, the valve bore 26 is opened, with simultaneous closure of the valve bore 29.

By this means, it is brought about that:

a. via the channels 25 and 41, the cylinder 39 is acted upon with the full driving medium force and, by this means, the valve member 12 is brought into the closure position by means of spring force;

b. the cylinder chamber 42 is very quickly filled with driving medium force via the by-pass groove 47 and the bore 45, as well as via the opened connection 19, 51 and 55;

c. upon the start of the stroke of the valve piston 8, the cylinder space 42 is additionally filledup via the throttle bore 48;

d. a powerfully dimensioned compression spring 11 forces the valve piston 8 with switch characteristic into the closed position.

Through the opening of several independent channels upon initiation of the closure procedure, a reliable rapid closure of the valve is at all times ensured.

The design of FIG. 2 differs from that in accordance with FIG. 1 substantially in that from the inlet side 16 of the valve 1 to the pressure chamber 42 of the valve piston 8 via a radial piston chamber 51, which is stepped in its outer diameter, of the valve member 12 there exists a further flow passage in the interior of the valve piston which passage can be shut-off at the stage 56 of the radial piston chamber 51 by means of an annularly projecting control collar 53 of the secondary valve member 12 in the open position thereof.

A further difference between the embodiment of FIG. 1 and that of FIG. 2 consists in that, in the valve of FIG. 2, the stepped radial piston chamber 51 of the secondary valve member 12 is the pressure chamber situated at the pressure-loaded stage of the same. On account of this constuction, the result is achieved that, through the most weakly throttled flow connection, which exists in the event of the closure of the valve and which is shut-off in the open state, into the pressure chamber during the closure driving medium can reflow in a sufficient amount, so that the delay of the closure procedure is reduced to minimum.

I claim:

1. A combined starting and rapid shut-off valve for a turbine comprising:

a housing (1) defining an inlet port (16) and an outlet port (37), a valve seat (43) circumscribing the outlet port (37), a flange (4) mounted relative to the housing (1) and having a flange bore (46) and a communicating flange chamber (24), a cylinder (6) having a cylinder chamber (42) centrally thereof and being carried by the flange (4) and extending inwardly therefrom and within the housing (1), a pressure medium controlled main valve (8) having a stepped main valve chamber (39) centrally thereof and said main valve being reciprocable within the cylinder chamber (42) toward and away from the valve seat (43), a spring (11) seated within the cylinder chamber (42) for urging the main valve (8) toward the valve seat (43), a spindle (10) having a through bore and carried by and projecting outwardly from the side of the main valve (8) remote from the valve seat (43) and being accommodated for radial play within the flange bore (46), a secondary valve opening (21) within the main valve (8), a main valve chamber spring (13) seated within the main valve chamber (39), the flange chamber (24) being in fluid communication with the main valve chamber (39) via the through bore of the spindle (10), a stepped secondary valve member (12) slidable in the stepped main valve chamber (39) and being biased by the main valve chamber spring (13) toward a closed position with respect to the secondary valve opening (21), the secondary valve opening (21) communicating with a piston chamber (51) in the main valve (8) and radial bores (19) through the main valve (8) when stepped secondary valve member (12) is opened and communicating only with outlet connection (37) when stepped secondary valve member (12) is closed, a pilot valve (5) mounted adjacent the flange (4) and having a pilot valve chamber with a passage to atmosphere (29), an inlet port passage (26) communicating between the pilot valve chamber and the inlet port (16), a double-acting pilot valve (28) movable within the pilot valve chamber between a first positon of blocking the passage to atmosphere (29) and a second position of closing off the inlet port passage (26), a radial central side connection (41) via the flange chamber (24) between the pilot valve chamber and the flange bore (46) wherein with the double-acting pilot valve (28) being in a first position a passage (25) leading from the interior of the housing (1) is connected to the flange bore (46) and being in a second position the flange bore (46) is vented to atmosphere, a groove (47) in the outer surface of the spindle (10) for establishing a fluid connection between the flange chamber (24) and the cylinder chamber (42) in the main valve fully-opened condition, and a valved throttling connection (48, 44) between the inlet port (16) and the cylinder chamber (42) with the cylinder chamber (42) providing a cushion against toorapid movement of the main valve (8) and with the degree of cushioning being determined by the play between the spindle (10) and the flange bore (46) and with the valved throttling connection regulating the flow of fluid to and from the cylinder chamber (42).

* * * * *